US007994078B2

(12) United States Patent
Reichmann et al.

(10) Patent No.: US 7,994,078 B2
(45) Date of Patent: Aug. 9, 2011

(54) HIGH STRENGTH NONWOVEN WEB FROM A BIODEGRADABLE ALIPHATIC POLYESTER

(75) Inventors: Mark G. Reichmann, Roswell, GA (US); Maya Aroch, Atlanta, GA (US); Joy Francine Jordan, Marietta, GA (US); Peter Michailovich Kobylivker, Marietta, GA (US); Rowland Jaynes McClellan, Jr., Alpharetta, GA (US); Ann Louise McCormack, Cumming, GA (US); Palani Raj Ramaswami Wallajapet, Neenah, WI (US); Vasily A. Topolkaraev, Appleton, WI (US); Dennis Y. Lee, Appleton, WI (US); Steven R. Stopper, Duluth, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1689 days.

(21) Appl. No.: 10/734,006

(22) Filed: Dec. 10, 2003

(65) Prior Publication Data

US 2004/0166758 A1 Aug. 26, 2004

Related U.S. Application Data

(60) Provisional application No. 60/436,041, filed on Dec. 23, 2002.

(51) Int. Cl.
*D04H 3/00* (2006.01)

(52) U.S. Cl. ..... 442/327

(58) Field of Classification Search ..... 442/400, 442/401, 361, 327; 428/359
See application file for complete search history.

(56) References Cited

U.S. PATENT DOCUMENTS

| | | | |
|---|---|---|---|
| 1,849,107 | A | 3/1932 | Moss |
| 2,703,316 | A | 3/1955 | Schneider |
| 3,338,992 | A | 8/1967 | Kinney |
| 3,341,394 | A | 9/1967 | Kinney |
| 3,502,763 | A | 3/1970 | Hartmann |
| 3,542,615 | A | 11/1970 | Dobo et al. |
| 3,692,618 | A | 9/1972 | Dorschner et al. |
| 3,802,817 | A | 4/1974 | Matsuki et al. |
| 3,849,241 | A | 11/1974 | Butin et al. |
| 3,855,046 | A | 12/1974 | Hansen et al. |
| D239,566 | S | 4/1976 | Vogt |
| D264,512 | S | 5/1982 | Rogers |
| 4,340,563 | A | 7/1982 | Appel et al. |
| 4,374,888 | A | 2/1983 | Bornslaeger |
| 4,418,116 | A | 11/1983 | Scott |
| 4,493,868 | A | 1/1985 | Meitner |
| 5,053,482 | A | 10/1991 | Tietz |
| 5,097,005 | A | 3/1992 | Tietz |
| 5,108,820 | A | 4/1992 | Kaneko et al. |
| 5,108,827 | A | 4/1992 | Gessner |
| 5,171,308 | A | 12/1992 | Gallagher et al. |
| 5,219,646 | A | 6/1993 | Gallagher et al. |
| 5,294,482 | A | 3/1994 | Gessner |
| 5,316,832 | A | 5/1994 | Groten et al. |
| 5,336,552 | A | 8/1994 | Strack et al. |
| 5,338,822 | A | 8/1994 | Gruber et al. |
| 5,382,400 | A | 1/1995 | Pike et al. |
| 5,437,918 | A | 8/1995 | Taniguchi et al. |
| 5,466,517 | A | 11/1995 | Eschwey et al. |
| 5,472,518 | A | 12/1995 | Patnode et al. |
| 5,525,706 | A | 6/1996 | Gruber et al. |
| 5,556,895 | A | 9/1996 | Lipinsky et al. |
| 5,618,911 | A | 4/1997 | Kimura et al. |
| 5,658,582 | A | 8/1997 | Dorigatti et al. |
| 5,698,322 | A | 12/1997 | Tsai et al. |
| 5,702,826 | A | 12/1997 | Ehret et al. |
| 5,707,468 | A | 1/1998 | Arnold et al. |
| 5,759,926 | A | 6/1998 | Pike et al. |
| 5,763,098 | A | 6/1998 | Kameoka et al. |
| 5,783,504 | A | 7/1998 | Ehret et al. |
| 5,783,505 | A | 7/1998 | Duckett et al. |
| 5,801,223 | A | 9/1998 | Lipinsky et al. |
| 5,807,973 | A | 9/1998 | Gruber et al. |
| 5,833,787 | A | 11/1998 | Ehret et al. |
| 5,834,582 | A | 11/1998 | Sinclair et al. |
| 5,851,937 | A | 12/1998 | Wu et al. |
| 5,866,675 | A | 2/1999 | Ahmed et al. |
| 5,874,486 | A * | 2/1999 | Bastioli et al. ..... 523/128 |
| 5,910,368 | A | 6/1999 | Ehret |
| 5,939,467 | A | 8/1999 | Wnuk et al. |
| 5,945,480 | A | 8/1999 | Wang et al. |
| 5,952,433 | A | 9/1999 | Wang et al. |
| 5,976,694 | A | 11/1999 | Tsai et al. |
| 5,985,776 | A | 11/1999 | Bertrand et al. |
| 6,020,453 | A | 2/2000 | Larsson et al. |
| 6,111,060 | A | 8/2000 | Gruber et al. |
| 6,114,495 | A | 9/2000 | Kolstad et al. |

(Continued)

FOREIGN PATENT DOCUMENTS

| | | |
|---|---|---|
| EP | 0 510 999 B1 | 6/1996 |

(Continued)

*Primary Examiner* — Norca L Torres-Velazquez
*Assistant Examiner* — Matthew D Matzek
(74) *Attorney, Agent, or Firm* — Ralph H. Dean; Alyssa A. Dudkowski; Kenya T. Pierre

(57) ABSTRACT

The present invention provides a nonwoven web prepared from an aliphatic polyester polymer which has sufficient tear strength and is biodegradable. Biodegradable nonwoven webs of the present are prepared from a polymer blend having from about 65% by weight to about 99% by weight of a biodegradable aliphatic polyester polymer and from about 1% by weight to about 35% by weight of a second polymer selected from the group consisting of a polymer having a lower melting point than the biodegradable aliphatic polyester polymer, a polymer having a lower molecular weight than the biodegradable aliphatic polyester polymer and mixtures thereof. Surprisingly, the nonwoven webs of the present invention have a tear strength greater than the tear strength of a nonwoven web prepared from the biodegradable aliphatic polyester polymer alone. In addition, other properties of the resulting nonwoven web, such as the tensile strength and energy to break, are not adversely affected, by the addition of the second polymer, in ways that make the resulting nonwoven web unusable for its intended purpose.

24 Claims, No Drawings

U.S. PATENT DOCUMENTS

| | | | | |
|---|---|---|---|---|
| 6,121,170 | A | 9/2000 | Tsai et al. | |
| 6,174,602 | B1 * | 1/2001 | Matsui et al. | 428/373 |
| 6,176,952 | B1 | 1/2001 | Maugans et al. | |
| 6,197,237 | B1 | 3/2001 | Tsai et al. | |
| 6,197,860 | B1 | 3/2001 | Tsai et al. | |
| 6,200,669 | B1 | 3/2001 | Marmon et al. | |
| 6,201,068 | B1 | 3/2001 | Tsai et al. | |
| 6,245,345 | B1 | 6/2001 | Swanbom et al. | |
| 6,261,677 | B1 | 7/2001 | Tsai et al. | |
| 6,268,434 | B1 | 7/2001 | Tsai et al. | |
| 6,284,680 | B1 | 9/2001 | Aikawa et al. | |
| 6,306,782 | B1 | 10/2001 | Tsai et al. | |
| 6,309,423 | B2 | 10/2001 | Hayes | |
| 6,309,988 | B1 | 10/2001 | Tsai et al. | |
| 6,353,086 | B1 | 3/2002 | Kolstad et al. | |
| 6,506,873 | B1 | 1/2003 | Ryan et al. | |
| 2002/0111596 | A1 * | 8/2002 | Fletcher et al. | 604/385.03 |

FOREIGN PATENT DOCUMENTS

| | | | | |
|---|---|---|---|---|
| EP | 0 765 913 | A | | 4/1997 |
| EP | 0 637 641 | B1 | | 9/1998 |
| EP | 0 734 321 | B1 | | 3/1999 |
| EP | 0 949 371 | A2 | | 10/1999 |
| EP | 0 765 959 | B1 | | 1/2000 |
| EP | 1 312 702 | A1 | | 5/2003 |
| EP | 0 990 678 | B1 | | 11/2003 |
| JP | 07-118922 | A | | 5/1995 |
| JP | 07-126970 | A | | 5/1995 |
| JP | 07-133511 | A | | 5/1995 |
| JP | 07-133569 | A | | 5/1995 |
| JP | 07-216646 | A | | 8/1995 |
| JP | 08-226016 | A | | 9/1996 |
| JP | 08-283392 | A | | 10/1996 |
| JP | 09-021017 | A | | 1/1997 |
| JP | 09-021018 | A | | 1/1997 |
| JP | 09-059356 | A | | 3/1997 |
| JP | 09-095847 | A | | 4/1997 |
| JP | 09-095852 | A | | 4/1997 |
| JP | 09-205827 | A | | 8/1997 |
| JP | 2000-199161 | A | | 7/2000 |
| JP | 2000-199163 | A | | 7/2000 |
| JP | 2000-234254 | A | | 8/2000 |
| JP | 2000-239969 | A | | 9/2000 |
| JP | 2001-049533 | A | | 2/2001 |
| JP | 2001-063757 | A | | 3/2001 |
| JP | 2001-123371 | A | | 5/2001 |
| JP | 2004011037 | A | * | 6/2002 |
| WO | WO 93/11803 | A1 | | 6/1993 |
| WO | WO 97/34953 | A1 | | 9/1997 |
| WO | WO 98/50611 | A1 | | 11/1998 |
| WO | WO 00/12791 | A1 | | 3/2000 |
| WO | WO 01/10929 | A1 | | 2/2001 |
| WO | WO 01/49912 | A1 | | 7/2001 |
| WO | WO 01/96639 | A1 | | 12/2001 |
| WO | WO 02/077335 | A | | 10/2002 |

* cited by examiner

HIGH STRENGTH NONWOVEN WEB FROM A BIODEGRADABLE ALIPHATIC POLYESTER

This application claims priority from U.S. Provisional Application No. 60/436,041, filed Dec. 23, 2002.

FIELD OF THE INVENTION

The present invention relates to a nonwoven web prepared from a polymer blend containing a biodegradable aliphatic polyester and a second polymer. The present invention also relates to a method of improving the strength of a nonwoven web prepared from a biodegradable aliphatic polyester polymer. In particular, the tear strength of the nonwoven web is improved.

BACKGROUND OF THE INVENTION

Nonwoven webs have been used to prepare a wide variety of products, including personal care products such as disposable diapers, training pants, swim wear, feminine care products, baby wipes and the like. Nonwoven webs have also been used to prepare may other articles of manufacture including health care products, such as surgical drapes, surgical mask, wound dressings and the like; wipes; mops; and filter materials, among many other uses.

Many of the items prepared from nonwoven webs are single use or limited use products. Most of the current nonwoven webs are prepared from polymers which are not biodegradable, such as polyolefins. Although currently available disposable baby diapers and other disposable products have been accepted by the public despite the fact that they are not biodegradable, these current products still would benefit from improvement in the area of disposal.

Many disposable absorbent products can be difficult to dispose. Attempts to flush many disposable absorbent products, such as diapers and feminine care products, down a toilet into a sewage system may lead to blockage of the toilet or pipes connecting the toilet to the sewage system. The outer cover materials in the disposable absorbent products in particular do not disintegrate or disperse when flushed down a toilet so that the disposable absorbent product cannot be disposed in this way. If the outer cover materials are made very thin to reduce the overall bulk in an attempt to reduce the likelihood of blockage of a toilet or a sewage pipe, then the outer cover material does not exhibit sufficient strength to prevent tearing or ripping as the outer cover material is subjected to the stresses of normal use by a wearer.

Solid waste disposal is becoming an ever increasing problem throughout the world. As landfills continue to fill up, a demand has increased for a material source reduction in disposable products. As an alternative, recyclable or biodegradable components are needed to be developed for incorporating into the disposable products. Products are desired to be developed for final disposal by means other than by incorporation into solid waste disposal facilities such as landfills.

Accordingly, there is a need for new materials to be used in disposable absorbent products which retain integrity and strength during use, but after such use, may be disposed of more efficiently. There is a need for new materials used in the disposable absorbent product to be disposed of easily and efficiently by composting. Alternatively, the disposable absorbent product may be disposed easily and efficiently in a liquid sewage system wherein the disposable absorbent product is capable of being degraded.

Attempts have been made to overcome some of the environmental shortcomings of the current disposable absorbent products by using aliphatic polyesters as the polymer component used to make the nonwoven web. However, problems have been encountered with fibers prepared from aliphatic polyesters. Aliphatic polyester polymers have been observed to exhibit a relatively slow crystallization rate as compared to polyolefin polymers. The slow crystallization rate causes poor processability of the aliphatic polyester polymers. In addition, in past attempts to make nonwovens from aliphatic polyesters have resulted in nonwoven webs with low strength, in particular low tear strength, making these nonwovens unusable in many applications.

SUMMARY OF THE INVENTION

The present invention provides a nonwoven web prepared from an aliphatic polyester polymer which has sufficient strength and is biodegradable. Biodegradable nonwoven webs of the present invention are prepared from a polymer blend having from about 65% by weight to about 99% by weight of a biodegradable aliphatic polyester polymer and front about 1% by weight to about 35% by weight of a second polymer selected from the group consisting of a polymer having a lower melting point than the biodegradable aliphatic polyester polymer, a polymer having a lower molecular weight than the biodegradable aliphatic polyester polymer and mixtures thereof. The nonwoven webs of the present invention have a tear strength, surprisingly greater than the tear strength of a nonwoven web prepared from the biodegradable aliphatic polyester polymer alone. In addition, other properties of the resulting nonwoven web, such as the tensile strength and energy to break, are not adversely affected by the addition of the second polymer, in ways that make the resulting nonwoven web unusable for its intended purpose.

The present invention provides a biodegradable fiber prepared from a blend of containing an aliphatic polyester polymer and a second polymer. The polymer blend has from about 65% by weight to about 99% by weight of a biodegradable aliphatic polyester polymer and from about 1% by weight to about 35% by weight of a second polymer selected from the group consisting of a polymer having a lower melting point than the biodegradable aliphatic polyester polymer, a polymer having a lower molecular weight than the biodegradable aliphatic polyester polymer and mixtures thereof. The fiber can be used to prepare both woven and nonwoven fabrics.

The present invention also relates to a method for increasing the tear strength of a biodegradable nonwoven web prepared from a biodegradable aliphatic polyester polymer. The method includes blending a biodegradable aliphatic polyester polymer and a second polymer selected from the group consisting of a polymer having a lower melting point than the biodegradable aliphatic polyester polymer, a polymer having a lower molecular weight than the biodegradable aliphatic polyester polymer and mixtures thereof; forming the nonwoven web from the polymer blend; and bonding the nonwoven web.

The nonwoven web of the present invention can be used in applications were nonwoven webs are currently used. For example, the biodegradable nonwoven may be use in personal care products, such as diapers, training pants, and feminine hygiene pads; medical products, such as surgical gowns, face mask and sterile wraps; filter material; insulation materials; wipers, both hard surface wipes and baby wipers.

DEFINITIONS

As used herein, the term "comprising" is inclusive or open-ended and does not exclude additional unrecited elements, compositional components, or method steps.

As used herein, "biodegradable" is meant to represent that a material degrades from the action of naturally occurring microorganisms such as bacteria, fungi, algae and the like. "Biodegradable" also is intended to include a material which degrades in the presence of oxygen over an extended period of time.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein, the term "fiber" includes both staple fibers, i.e., fibers which have a defined length between about 19 mm and about 60 mm, fibers longer than staple fiber but are not continuous, and continuous-fibers, which are sometimes called "substantially continuous filaments" or simply "filaments". The method in which the fiber is prepared will determine if the fiber is a staple fiber or a continuous filament.

As used herein, the term "nonwoven web" means a web having a structure of individual fibers or threads which are interlaid, but not in an identifiable manner as in a knitted web. Nonwoven webs have been formed from many processes, such as, for example, meltblowing processes, spunbonding processes, air-laying processes, coforming processes and bonded carded web processes. The basis weight of nonwoven webs is usually expressed in ounces of material per square yard (osy) or grams per square meter (gsm) and the fiber diameters useful are usually expressed in microns, or in the case of staple fibers, denier. It is noted that to convert from osy to gsm, multiply osy by 33.91.

As used herein the term "spunbond fibers" refers to small diameter fibers of molecularly oriented polymeric material. Spunbond fibers may be formed by extruding molten thermoplastic material as filaments from a plurality of fine, usually circular capillaries of a spinneret with the diameter of the extruded filaments then being rapidly reduced as in, for example, U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,542,615 to Dobo et al, and U.S. Pat. No. 5,382,400 to Pike et al. Spunbond fibers are generally not tacky when they are deposited onto a collecting surface and are generally continuous. Spunbond fibers are often about 10 microns or greater in diameter. However, fine fiber spunbond webs (having an average fiber diameter less than about 10 microns) may be achieved by various methods including, but not limited to, those described in commonly assigned U.S. Pat. No. 6,200,669 to Marmon et al. and U.S. Pat. No. 5,759,926 to Pike et al., each is hereby incorporated by reference in its entirety.

As used herein, the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin, which is hereby incorporated by reference in its entirety. Meltblown fibers are microfibers, which may be continuous or discontinuous, and are generally smaller than 10 microns in average diameter The term "meltblown" is also intended to cover other processes in which a high velocity gas, (usually air) is used to aid in the formation of the filaments, such as melt spraying or centrifugal spinning.

"Bonded carded web" refers to webs that are made from staple fibers which are sent through a combing or carding unit, which separates or breaks apart and aligns the staple fibers in the machine direction to form a generally machine direction-oriented fibrous nonwoven web. Such fibers are usually purchased in bales which are placed in an opener/blender or picker which separates the fibers prior to the carding unit. Once the web is formed, it then is bonded by one or more of several known bonding methods. One such bonding method is powder bonding, wherein a powdered adhesive is distributed through the web and then activated, usually by heating the web and adhesive with hot air. Another suitable bonding method is pattern bonding, wherein heated calender rolls or ultrasonic bonding equipment are used to bond the fibers together, usually in a localized bond pattern, though the web can be bonded across its entire surface if so desired. Another suitable and well-known bonding method, particularly when using bicomponent staple fibers, is through-air bonding.

"Airlaying" or "airlaid" is a well known process by which a fibrous nonwoven layer can be formed. In the airlaying process, bundles of small fibers having typical lengths ranging from about 3 to about 19 millimeters (mm) are separated and entrained in an air supply and then deposited onto a forming screen, usually with the assistance of a vacuum supply. The randomly deposited fibers then are bonded to one another using, for example, hot air or a spray adhesive.

As used herein, the term "multicomponent fibers" refers to fibers or filaments which have been formed from at least two polymers extruded from separate extruders but spun together to form one fiber. Multicomponent fibers are also sometimes referred to as "conjugate" or "bicomponent" fibers or filaments. The term "bicomponent" means that there are two polymeric components making up the fibers. The polymers are usually different from each other, although conjugate fibers may be prepared from the same polymer, if the polymer in each component is different from one another in some physical property, such as, for example, melting point or the softening point. In all cases, the polymers are arranged in substantially constantly positioned distinct zones across the cross-section of the multicomponent fibers or filaments and extend continuously along the length of the multicomponent fibers or filaments. The configuration of such a multicomponent fiber may be, for example, a sheath/core arrangement, wherein one polymer is surrounded by another, a side-by-side arrangement, a pie arrangement or an "islands-in-the-sea" arrangement. Multicomponent fibers are taught in U.S. Pat. No. 5,108,820 to Kaneko et al.; U.S. Pat. No. 5,336,552 to Strack et al.; and U.S. Pat. No. 5,382,400 to Pike et al.; the entire content of each is incorporated herein by reference. For two component fibers or filaments, the polymers may be present in ratios of 75/25, 50/50, 25/75 or any other desired ratios.

As used herein, the term "multiconstituent fibers" refers to fibers which have been formed from at least two polymers extruded from the same extruder as a blend or mixture. Multiconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Fibers of this general type are discussed in, for example, U.S. Pat. Nos. 5,108,827 and 5,294,482 to Gessner.

As used herein, the term "pattern bonded" refers to a process of bonding a nonwoven web in a pattern by the application of heat and pressure or other methods, such as ultrasonic bonding. Thermal pattern bonding typically is carried out at a temperature in a range of from about 80° C. to about 180° C. and a pressure in a range of from about 150 to about 1,000 pounds per linear inch (59-178 kg/cm). The pattern employed typically will have from about 10 to about 250 bonds/inch$^2$ (1-40 bonds/cm$^2$) covering from about 5 to about 30 percent of the surface area. Such pattern bonding is accomplished in accordance with known procedures. See, for example, U.S. Design Pat. No. 239,566 to Vogt, U.S. Design Pat. No. 264,512 to Rogers, U.S. Pat. No. 3,855,046 to Hansen et al., and U.S. Pat. No. 4,493,868, supra, for illustrations of bonding patterns and a discussion of bonding procedures, which patents are incorporated herein by reference. Ultrasonic bonding is performed, for example, by passing the multilayer nonwoven web laminate between a sonic horn and anvil roll as illustrated in U.S. Pat. No. 4,374,888 to Bornslaeger, which is hereby incorporated by reference in its entirety.

As used herein the term "denier" refers to a commonly used expression of fiber thickness which is defined as grams per 9000 meters. A lower denier indicates a finer fiber and a higher denier indicates a thicker or heavier fiber. Denier can be converted to the international measurement "dtex", which is defined as grams per 10,000 meters, by dividing denier by 0.9.

DETAILED DESCRIPTION OF THE INVENTION

The present invention provides a nonwoven web prepared from an aliphatic polyester polymer which has sufficient tear strength and is biodegradable. Biodegradable nonwoven webs of the present invention are prepared from a polymer blend of a biodegradable aliphatic polyester polymer and a second polymer, wherein the second polymer has a lower melting point than the biodegradable aliphatic polyester polymer and/or a lower molecular weight than the biodegradable aliphatic polyester. Surprisingly, the nonwoven webs of the present invention have a tear strength which is substantially greater than the tear strength of a nonwoven web prepared from the biodegradable aliphatic polyester polymer alone. In addition, other properties of the resulting nonwoven web, such as the tensile strength, are not adversely affected by the addition of the second polymer to any great degree which makes the resulting nonwoven usable for it intended purpose.

In the present invention, the aliphatic polyester can be any biodegradable aliphatic polyester polymer. Examples of biodegradable aliphatic polyesters usable in the present invention include, but are not limited to polyhydroxy butyrate (PHP), polyhydroxy butyrate-co-valerate (PHBV), polycaprolactane, polybutylene succinate, polybutylene succinate-co-adipate, polyglycolic acid (PGA), polylactide or polylactic acid (PLA), polybutylene oxalate, polyethylene adipate, polyparadioxanone, polymorpholineviones, and polydioxipane-2-one. Of these aliphatic polyesters, polyglycolic acid and polylactide (polylactic acid) are desirable due to the availability and recent manufacturing advances. Due to current cost considerations, polylactide (polylactic acid) is most desired.

Polylactides are sometimes referred to as polylactic acid. As used herein, the term polylactide is intended to cover both polylactides and polylactic acid. Polylactides are often abbreviated "PLA". Polylactide polymers are commercially available from Cargill-Dow LLC, Minnetonka, Minn., for example, 6200 D grade as described by EP 1 312 702 A1, from PURAC America, Lincolnshire, Ill. and from Biomer, Krailling Germany. Polylactides are also described in U.S. Pat. Nos. 5,338,822; 6,111,060; 5,556,895; 5,801,223; 6,353,086; and 6,506,873, each hereby incorporated by reference in its entirety.

The second polymer is blended with the biodegradable aliphatic polyester polymer prior to fiber and/or nonwoven web formation. The selection of the second polymer is such that the second polymer is thermoplastic and it has a lower melting point and/or a lower molecular weight than the biodegradable aliphatic polyester polymer. The second polymer is generally an amorphous polymer. Addition of the second polymer would favorably influence the melt rheology of the blend and improve bonding under the process conditions used. Further, the second polymer is desirably compatible with the first polymer. Examples of such polymers include hydrogenated hydrocarbon resins, such as REGALREZ® series tackifiers and ARKON® P series tackifiers. REGALREZ® tackifiers are available from Hercules, Incorporated of Wilmington, Del. REGALREZ® tackifiers are highly stable, light-colored, low molecular weight, nonpolar resins. Grade 3102 is said to have a softening point of 102 R&B° C., a specific gravity at 21° C. of 1.04, a melt viscosity of 100 poise at 149° C. and a glass transition temperature, Tg, of 51° C. REGALREZ® 1094 tackifier is said to have a softening point of 94° C., a specific gravity at 21° C. of 0.99, a melt viscosity of 100 poise at 126° C. and a glass transition temperature, Tg, of 33° C. Grade 1126 is said to have a softening point of 126° C., a specific gravity at 21° C. of 0.97, a melt viscosity of 100 poise at 159° C. and a glass transition temperature, Tg, of 65° C. ARKON®P series resins are synthetic tackifying resins made by Arakawa Chemical (U.S.A.), Incorporated of Chicago, Ill. from petroleum hydrocarbon resins. Grade P-70, for example, has a softening point of 70° C., while grade P-100 has a softening point of 100° C. and Grade P-125 has a softening point of 125° C. ZONATEC® 501 lite resin is another tackifier which is a terpene hydrocarbon with a softening point of 105° C. made by Arizona Chemical Company of Panama City, Fla. EASTMAN® 1023PL resin is an amorphous polypropylene tackifying agent with a softening point of 150-155° C. available from Eastman Chemical Company Longview, Tex.

Generally, other examples the second polymer include, but are not limited to, polyamides, ethylene copolymers derived from ethylene and a non-hydrocarbon monomer such as ethylene vinyl acetate (EVA), ethylene ethyl acrylate (EEA), ethylene acrylic acid (EAA), ethylene methyl acrylate (EMA) and ethylene normal-butyl acrylate (ENBA), wood rosin and its derivatives, hydrocarbon resins, polyterpene resins, atactic polypropylene and amorphous polypropylene. Also included are predominately amorphous ethylene propylene copolymers commonly known as ethylene-propylene rubber (EPR) and a class of materials referred to as toughened polypropylene (TPP) and olefinic thermoplastic polymers where EPR is mechanically dispersed or molecularly dispersed via in-reactor multistage polymerization in polypropylene or polypropylene/polyethylene blends. Other polymers useable as the second polymer component hetrophasic polyproplyene available under the trade designation Catalloy KS 357 P available from Montell.

In addition, polyalphaolefin resins can also be used as the second polymer. Polyalphaolefins usable in the present invention desirably have a melt viscosity of 100,000 mPa sec or greater. Commercially available amorphous polyalphaolefins, such as those used in hot melt adhesives, are suitable for use with the present invention and include, but are not limited to, REXTAC® ethylene-propylene APAOE-4 and E-5 and butylene-propylene BM-4 and BH-5, and REXTAC® 2301 from Rexene Corporation of Odessa, Tex., and VESTOPLAST® 792, VESTOPLAST® 520, or VESTOPLAST® 608 from Huls AG of Marl, Germany. These amorphous polyolefins are commonly synthesized on a Ziegler-Natta supported catalyst and an alkyl aluminum co-catalyst, and the olefin, such as propylene, is polymerized in combination with varied amounts of ethylene, 1-butene, 1-hexane or other materials to produce a predominantly atactic hydrocarbon chain.

In addition to the above second polymers, other biodegradable polymers having a molecular weight less than the biodegradable aliphatic polyester polymer. Blending of the second biodegradable polymer should result in a polymer blend with improved polymer melt rheology and provide an improvement in bonding under the process conditions used. It has been discovered that the tear strength of a nonwoven fabric produced from a mixture of a crystalline polylactide and a second polylactide which has a lower melting point as compared to the crystalline polylactide is vastly improved over the tear strength of a nonwoven from the crystalline polylactide alone.

Although other aliphatic polyesters may be used in the present invention, as is noted above, polylactides are the desired biodegradable polymer due to cost and availability. However, in order to form a nonwoven web from polylactides several considerations must be taken into account. For example, many polylactides have poor melt stability and tend to rapidly degrade at elevated temperatures, typically in excess of 210° C. and may generate by-products in sufficient quantity to foul or coat processing equipment. Desirably, the polylactide should be sufficiently melt-processable in melt-processing equipment such as that available commercially. Further, the polylactide should desirably retain adequate molecular weight and viscosity. The polymer should have a sufficiently low viscosity at the temperature of melt-processing so that the extrusion equipment may create an acceptable nonwoven fabric. The temperature at which this viscosity is sufficiently low will preferably also be below a temperature at which substantial degradation occurs.

In the practice of the present invention in producing a nonwoven web, the polylactides desirably has a number average molecular weight from about 10,000 to about 300,000, depending on the type of nonwoven web being formed. For example, in a composition for a meltblown nonwoven, a polylactide having a number average molecular weight ranges from about 15,000 to about 100,000 should be used. Desirably, the number average molecular weight should be in the range from about 20,000 to about 80,000 for a meltblown web. In contrast, for a spunbond nonwoven fabric, the desired number average molecular weight range is from about 50,000 to about 250,000, and more desirably, the number average molecular weight range is from about 75,000 to about 200,000.

The lower limit of molecular weight of the polymer compositions of the present invention is set at a point above the threshold of which a fiber has sufficient diameter and density. In other words, the molecular weight cannot be lower than is necessary to achieve a targeted fiber diameter and density. The practical upper limit on molecular weight is based on increased viscosity with increased molecular weight. In order to melt-process a high molecular weight polylactide, the melt-processing temperature must be increased to reduce the viscosity of the polymer. The exact upper limit on molecular weight can be determined for each melt-processing application in that required viscosities vary and residence time within the melt-processing equipment will also vary. Thus, the degree of degradation in each type of processing system will also vary. One skilled in the art could determine the suitable molecular weight upper limit for meeting the viscosity and degradation requirements in any application and the equipment being used.

The polylactides used as the biodegradable aliphatic polyester are desirably crystalline. Polylactides with a predominate L-lactide configuration are more crystalline than polylactides having a portion of D-lactide configuration. The D-lactide configuration isomer is an impurity which is naturally formed during the production of the poly(l-lactide). The larger the percentage of the D-isomer present in the polylactide, the slower the rate of crystallization. Ideally, in the present invention it is desirable the polylactide have less than about 4.5% by weight of the D-isomer. Desirably, the D-isomer should make-up less than about 3.0% by weight and more desirable less than about 2.0% by weight of the poly(L-lactide).

Lactide polymers may also be in either an essentially amorphous form or in a semi-crystalline form. Generally, the desired range of compositions for semi-crystalline poly(lactide) is less than about 6% by weight D-isomer lactide and the remaining percent by weight either L-lactide or D-lactide, with L-lactide being more readily available. A more preferred composition contains less than about 4.5% by weight D-lactide with the remainder being substantially all L-lactide.

In polylactides which are amorphous polymers, the preferred composition of the reaction mixture is above 4.5% by weight D-lactide and a more desirably above 6.0% by weight D-lactide with the remaining lactide being substantially all L-lactide mixture. Stated another way, the more D-lactide present in a given polylactide, the less crystalline the polylactide. The D-lactide isomer can be used to control the crystallinity in a predominantly L-lactide polylactide polymer.

Even small amounts of D-lactide in a polymer will be slower to crystallize than polymerization mixtures having lesser amounts of D-lactide. Beyond about 6.0% by weight of the D-lactide content, the polymer remains essentially amorphous following a typical annealing procedure.

The polydispersity index (PDI) of the polylactide polymer is generally a function of branching or crosslinking and is a measure of the breadth of the molecular weight distribution. In most applications where crystalline polylactide is desired, the PDI of the polylactide polymer should be between about 1.5 and about 3.5, and preferably between about 2.0 and about 3.0. Of course, increased bridging or crosslinking may increase the PDI Furthermore, the melt flow index of the polylactide polymer should be in the ranges measured at 210° C. with a 2.16 Kg weight. For meltblown fibers the melt flow index should be between about 50 and 5000, and preferably between about 100 and 2000. For spunbond fibers the melt flow index should be between about 10 and 100, and more preferably between about 25 and about 75.

In the present invention, the nonwoven fabric can be prepared from monocomponent fibers or multicomponent fibers. The nonwoven web can be a meltblown nonwoven web, a spunbond nonwoven web, a bonded carded web, or an airlaid web. In each case, if the fibers are multicomponent fibers, a portion of the fibers may have a sheath/core, a side-by-side, and island-in-seas or a pie configuration. When the blend in used in a sheath/core fiber, the blend of polymer components in the present invention can be used in the sheath or the core of the multicomponent polymer. It is noted; however, that it is desirable for the sheath component to have the polymer blend of the present invention and the core component should have a higher melting point than the sheath. The core component or the other components of the multicomponent fibers can be any polymer or mixture of polymers, provided that other polymer or polymer mixture has a higher melting point than the mixture of the present invention. Ideally, the other component of the multicomponent should also be a biodegradable polymer and desirably an aliphatic polyester, so that the resulting nonwoven will be biodegradable.

In another embodiment of the present invention, instead for forming a nonwoven web from the forming fibers, the fibers can be formed as continuous filaments and wound onto a spool. The fiber of the present invention can be converted to staple fiber or can be used in a continuous form. The fibers may be multicomponent fibers or monocomponent fibers. If the fibers are multicomponent fibers, it is desirable that a portion of the outside surface of the fiber contains the polymer blend.

In preparing the blend used in the nonwoven fabrics and fibers of the present invention, the aliphatic polyester and the second polymer are blended using conventional mixing equipment, such as mixer. In addition, the components may be mixed in an extruder used to extrude the polymer through the spinnerets, pre-compounded into pellets and the like. Once blended the polymer blend is extruded through spinneret or a spinplate at a given rate. The resulting fibers are drawn using conventional drawing equipment, such as a fiber draw unit, and the resulting fibers are then collected. In the case of forming continuous filaments per se, take-up reels are used to collect the filaments. If a nonwoven web is to be formed, the fibers are deposited and collected on a surface, commonly called a "forming surface" or "forming wire". The formed web is then bonded to form the resulting nonwoven web.

The fiber or filaments of the nonwoven web may be generally bonded in some manner as they are produced in order to give them sufficient structural integrity to withstand the rigors of further processing into a finished product. Bonding can be accomplished in a number of ways such as ultrasonic bonding, adhesive bonding and thermal bonding. Ultrasonic bonding is performed, for example, by passing the nonwoven web between a sonic horn and anvil roll as illustrated in U.S. Pat. No. 4,374,888 to Bornslaeger, which is hereby incorporated by reference in its entirety.

Thermal bonding of a nonwoven web may be accomplished by passing the web between the rolls of a calendering machine. At least one of the rollers of the calender is heated and at least one of the rollers, not necessarily the same one as the heated one, has a pattern which is imprinted upon the laminate as it passes between the rollers. As the laminate passes between the rollers, the laminate is subjected to pressure as well as heat. The combination of heat and pressure applied in a particular pattern results in the creation of fused bond areas in the multilayer laminate where the bonds thereon correspond to the pattern of bond points on the calender roll.

Various patterns for calender rolls have been developed. One example is the Hansen-Pennings pattern with between about 10 to 25% bond area with about 100 to 500 bonds/square inch as taught in U.S. Pat. No. 3,855,046 to Hansen and Pennings. Another common pattern is a diamond pattern with repeating and slightly offset diamonds. The particular bond pattern can be selected from widely varying patterns known to those skilled in the art. The bond pattern is not critical for imparting the properties to the liner or mat of the present invention.

The exact calender temperature and pressure for bonding the nonwoven web depend on the polymers from which the nonwoven webs. Generally for nonwoven web formed from polylactides, the preferred temperatures are between 250° and 350° F. (121° and 177° C.) and the pressure between 100 and 1000 pounds per linear inch. More particularly, for polylactic acid, the preferred temperatures are between 270° and 320° F. (132° and 160° C.) and the pressure between 150 and 500 pounds per linear inch. However, the actual temperature and pressures need are highly dependent of the particular polymers used. The actual temperature and pressure used to bond the fibers of the nonwoven together will be readily determined by those skilled in the art. Of the available methods for bonding the layer of the nonwoven web usable in the present invention, thermal and ultrasonic bonding are preferred due to factors such as materials cost and ease of processing.

Using the polymer blend of the present invention as the polymer to form the nonwoven web, results in a nonwoven web having improved tear strength, as compared to a nonwoven web formed from the biodegradable aliphatic polyester alone. It was rather surprising that the resulting nonwoven web had improved tear strength without adversely affecting biodegradability or other physical properties, such as tensile strength.

In addition to the thermoplastic polymers present in the polymer blend used to prepare the fibers and/or nonwoven fabrics of the present invention may contain additives, such as fillers, surface treating agents, and the like. Further, the nonwoven web and fiber of the present invention may be surface treated to render the surface hydrophilic. Typically, the aliphatic polyesters are hydrophobic. Examples of such surface treatments include, but are not limited to, coating with hydrophilic polymers, corona glow discharge etc.

The nonwoven web and fibers of the present invention can be used in applications where nonwoven webs and fibers are currently used. For example, the biodegradable nonwoven and fibers may be use in personal care products, such as diapers, swim wear, training pants, and feminine hygiene pads; medical products, such as surgical gowns, face mask and sterile wraps; filter material: insulation materials; wipers, both hard surface wipes and baby wipers.

EXAMPLES

Example 1

A dry blend containing 95 wt % of a polylactic acid available from Cargill-Dow, LLC, 6200 D grade and 5 wt. % of Vestoplast 792 (amorphous propene-rich polyalphaolefin, 0.865 g/cc, melt viscosity at 190° C. of 125,000 mPa-sec according to DIN 53019) available from Huls America, Inc. of Somerset, N.J., which is a polyalphaolefin having an Mn of about 23,800, a Mw of about 118,000 and a softening point of about 108° C. was formed. The blend was extruded in an extruder at a temperature of about 430° C. The blend was then spun through a spinplate having 50 hole/in (20 holes/cm) at a throughput of 0.26 grams per hole per minute. The resulting fibers were drawn through a fiber draw unit at about 14° C. and a pressure of about 5 psi. The resulting spunbond nonwoven fabric was subjected to a hot air knife treatment at 150° C. of the type described in U.S. Pat. No. 5,707,468 to Arnold et al. The nonwoven fabric was lightly bonded using two smooth compaction rolls set at 104° C. and a bond pressure of 10 psi. The resulting lightly bonded spunbond nonwoven fabric had a basis weight of about 34 gsm.

The nonwoven fabric was then subjected to a variety of bonding temperature 270° F. (132° C.), 275° F. (135° C.) and 280° F. (138° C.) and pressures of 150 pli (263 N/cm) and 450 pli (788 N/cm) at line speeds of 30 ft/min (9.1 m/min), 75 ft/min (22.9 m/min) and 100 feet/min (30.5 m/min) using a point bond pattern. Tensile strength, measured in pounds, and energy to break, measured in lb-in, were measure in accordance with standard ASTM procedures. Tear strength was measured using an Elmendorf Digi-Tear Textest FX3700 machine and is reported in grams. The average MD/CD tear strength, tensile strength and energy to break were calculated. The results are reported in Table 1.

Example 2

A dry blend containing 70 wt % of a polylactic acid available from Cargill-Dow, LLC, 6200 D grade and 30 wt. % of a polylactic acid available from Cargill-Dow, LLC, 6700 D grade was formed. The blend was extruded in an extruder at a temperature of about 430° C. The blend was then spun through a spinplate having 50 hole/in (20 holes/cm) at a throughput of 0.26 grams per hole per minute. The resulting fibers were drawn through a fiber draw unit at about 14° C. and a pressure of about 5 psi. The resulting spunbond nonwoven fabric was subjected to a hot air knife treatment at 150° C. of the type described in U.S. Pat. No. 5,707,468 to Arnold et al. The nonwoven fabric was lightly bonded using two smooth compaction rolls set at 104° C. and a bond pressure of 10 psi. The resulting lightly bonded spunbond nonwoven fabric had a basis weight of about 34 gsm.

The nonwoven fabric was then subjected to a variety of bonding temperature 270° F. (132° C.), and 275° F. (135° C.) and pressures of 150 pli (263 N/cm) and 450 pli (788 N/cm) at line speeds of 30 ft/min (9.1 m/min), 75 ft/min (22.9 m/min) and 100 feet/min (30.5 m/min) using a point bond pattern. Tensile strength, measured in pounds, and energy to break, measured in lb-in, were measure in accordance with standard ASTM procedures. Tear strength was measured using an Elmendorf Digi-Tear Textest FX3700 machine and is reported in grams. The average MD/CD tear strength, tensile strength and energy to break were calculated. The results are reported in Table 2.

Comparative Example 1

A polylactic acid available from Cargill-Dow, LLC, 6200 D grade was extruded in an extruder at a temperature of about 430° C. The polylactide was then extruded spun through a spinplate having 50 hole/in (20 holes/cm) at a throughput of 0.4 grams per hole per minute. The resulting fibers were drawn through a fiber draw unit at about 14° C. and a pressure of about 15 psi. The resulting spunbond nonwoven fabric was subjected to a hot air knife treatment at 150° C. of the type described in U.S. Pat. No. 5,707,468 to Arnold et al. The nonwoven fabric was lightly bonded using two smooth compaction rolls set at 104° C. and a bond pressure of 25 psi. The resulting lightly bonded spunbond nonwoven fabric had a basis weight of about 34 gsm.

The nonwoven fabric is then subjected to a variety of bonding temperature 280° F. (138° C.), 285° F. (141° C.), 290° F. (144° C.) and 295° F. (147° C.) and pressures of 150 pli (263 N/cm) and 450 pli (788 N/cm) at line speeds of 30 ft/min (9.1 m/min), 75 ft/min (22.9 m/min) and 100 feet/min (30.5 m/min) using a point bond pattern. Tensile strength, measured in pounds, and energy to break, measured in lb-in, were measure in accordance with standard ASTM procedures. Tear strength was measured using an Elmendorf Digi-Tear Textest FX3700 machine and is reported in grams. The average MD/CD tear strength, tensile strength and energy to break were calculated. The results are reported in Table 3.

TABLE 1

| Run | Temp: (° F.) | Pressure (pli) | Line Speed (ft/min) | CD Tear | MD Tear | Tear (MD + CD)/2 | MD Tensile Load | CD Tensile Load | Tensile (MD + CD)/2 | MD Energy | CD Energy | Energy (MD + CD)/2 |
|---|---|---|---|---|---|---|---|---|---|---|---|---|
| 1 | 270 | 150 | 30 | 669.6 | 710.5 | 690.1 | 7.96 | 2.02 | 4.99 | 1.61 | 1.24 | 1.42 |
| 2 | 275 | 150 | 30 | 488.4 | 598.3 | 543.3 | 8.64 | 2.39 | 5.52 | 2.99 | 1.49 | 2.24 |
| 3 | 280 | 150 | 30 | 401.9 | 533.7 | 467.8 | 5.06 | 2.11 | 3.59 | 1.45 | 1.52 | 1.48 |
| 4 | 270 | 450 | 30 | 279.5 | 559.7 | 419.6 | 5.98 | 2.40 | 4.19 | 1.54 | 1.75 | 1.65 |
| 5 | 275 | 450 | 30 | 248.7 | 437.6 | 343.1 | 6.56 | 2.76 | 4.66 | 2.83 | 2.09 | 2.46 |
| 6 | 280 | 450 | 30 | 331.5 | 504.4 | 418.0 | 6.75 | 3.00 | 4.88 | 2.63 | 2.09 | 2.36 |
| 7 | 270 | 150 | 75 | 586.4 | 673.6 | 630.0 | 5.85 | 1.24 | 3.54 | 0.77 | 0.51 | 0.64 |
| 8 | 275 | 150 | 75 | 417.0 | 605.7 | 511.4 | 4.77 | 2.55 | 3.66 | 1.22 | 1.82 | 1.52 |
| 9 | 280 | 150 | 75 | 440.5 | 647.0 | 543.7 | 4.39 | 3.06 | 3.73 | 1.18 | 2.31 | 1.75 |
| 10 | 270 | 450 | 75 | 206.6 | 559.8 | 383.2 | 5.18 | 2.18 | 3.68 | 1.30 | 1.21 | 1.26 |
| 11 | 275 | 450 | 75 | 289.4 | 533.5 | 411.4 | 6.16 | 2.87 | 4.51 | 1.59 | 1.96 | 1.78 |
| 12 | 280 | 450 | 75 | 218.0 | 489.8 | 353.9 | 5.31 | 3.00 | 4.16 | 1.82 | 2.36 | 2.09 |
| 13 | 270 | 150 | 100 | 491.5 | 569.7 | 530.6 | 3.69 | 1.81 | 2.75 | 0.62 | 1.09 | 0.85 |
| 14 | 275 | 150 | 100 | 439.0 | 624.4 | 531.7 | 3.92 | 3.08 | 3.50 | 1.08 | 2.08 | 1.58 |
| 15 | 280 | 150 | 100 | 557.9 | 551.9 | 554.9 | 4.52 | 2.51 | 3.51 | 1.24 | 1.77 | 1.50 |
| 16 | 270 | 450 | 100 | 225.0 | 313.8 | 269.4 | 4.97 | 2.31 | 3.64 | 0.22 | 1.44 | 0.83 |
| 17 | 275 | 450 | 100 | 235.8 | 497.3 | 366.6 | 5.64 | 3.20 | 4.42 | 0.50 | 2.12 | 1.31 |
| 18 | 280 | 450 | 100 | 243.3 | 446.6 | 345.0 | 5.05 | 2.90 | 3.98 | 1.81 | 2.07 | 1.94 |

TABLE 2

| Run | Temp: (° F.) | Pressure (pli) | Line Speed (ft/min) | CD Tear | MD Tear | Tear (MD + CD)/2 | MD Tensile Load | CD Tensile Load | Tensile (MD + CD)/2 | MD Energy | CD Energy | Energy (MD + CD)/2 |
|---|---|---|---|---|---|---|---|---|---|---|---|---|
| 19 | 270 | 150 | 30 | 199.3 | 356.8 | 278.1 | 8.47 | 2.67 | 5.57 | 3.68 | 2.12 | 2.90 |
| 20 | 275 | 150 | 30 | 226.4 | 343.9 | 285.1 | 8.74 | 2.35 | 5.55 | 3.54 | 1.62 | 2.58 |
| 21 | 270 | 450 | 30 | 170.4 | 300.4 | 235.4 | 9.99 | 2.69 | 6.34 | 5.28 | 2.12 | 3.70 |
| 22 | 275 | 450 | 30 | 247.8 | 395.3 | 321.5 | 10.72 | 2.68 | 6.70 | 5.31 | 1.88 | 3.59 |
| 23 | 270 | 150 | 75 | 286.6 | 384.9 | 335.8 | 7.18 | 2.96 | 5.07 | 3.07 | 2.37 | 2.72 |
| 24 | 275 | 150 | 75 | 347.9 | 510.8 | 429.3 | 4.30 | 1.61 | 2.95 | 1.43 | 1.00 | 1.21 |
| 25 | 270 | 450 | 75 | 212.9 | 354.8 | 283.9 | 8.81 | 2.92 | 5.86 | 4.00 | 2.50 | 3.25 |

TABLE 2-continued

| Run | Temp: (° F.) | Pressure (pli) | Line Speed (ft/min) | CD Tear | MD Tear | Tear (MD + CD)/2 | MD Tensile Load | CD Tensile Load | Tensile (MD + CD)/2 | MD Energy | CD Energy | Energy (MD + CD)/2 |
|---|---|---|---|---|---|---|---|---|---|---|---|---|
| 26 | 270 | 150 | 100 | 555.7 | 549.4 | 552.5 | 9.42 | 2.79 | 6.10 | 3.69 | 2.12 | 2.90 |
| 27 | 275 | 150 | 100 | 388.7 | 619.8 | 504.3 | 5.02 | 3.11 | 4.06 | 1.27 | 2.47 | 1.87 |
| 28 | 270 | 450 | 100 | 341.5 | 466.3 | 403.9 | 6.54 | 2.99 | 4.76 | 3.09 | 2.30 | 2.70 |

TABLE 3

| Run | Temp: (° F.) | Pressure (pli) | Line Speed (ft/min) | CD Tear | MD Tear | Tear (MD + CD)/2 | MD Tensile Load | CD Tensile Load | Tensile (MD + CD)/2 | MD Energy | CD Energy | Energy (MD + CD)/2 |
|---|---|---|---|---|---|---|---|---|---|---|---|---|
| 101 | 280 | 150 | 30 | 125.9 | 131.6 | 128.7 | 10.82 | 1.17 | 6.00 | 3.29 | 0.51 | 1.90 |
| 102 | 285 | 150 | 30 | 139.1 | 129.4 | 134.3 | 10.05 | 1.08 | 5.57 | 2.84 | 0.63 | 1.74 |
| 103 | 295 | 150 | 30 | 63.3 | 131.8 | 97.6 | 11.69 | 1.07 | 6.38 | 3.17 | 0.51 | 1.84 |
| 104 | 280 | 450 | 30 | 119.9 | 142.5 | 131.2 | 11.88 | 1.31 | 6.59 | 3.63 | 0.69 | 2.16 |
| 105 | 285 | 450 | 30 | 114.5 | 137.5 | 126.0 | 11.48 | 1.08 | 6.28 | 2.75 | 0.57 | 1.66 |
| 106 | 290 | 450 | 30 | 133.2 | 122.6 | 127.9 | 11.56 | 1.32 | 6.44 | 3.00 | 0.73 | 1.86 |
| 107 | 295 | 450 | 30 | 82.0 | 124.2 | 103.1 | 10.65 | 1.25 | 5.95 | 0.97 | 0.63 | 0.80 |
| 108 | 280 | 150 | 75 | 185.3 | 146.9 | 166.1 | 9.79 | 1.24 | 5.51 | 3.29 | 0.57 | 1.93 |
| 109 | 285 | 150 | 75 | 148.9 | 137.0 | 142.9 | 6.48 | 1.36 | 3.92 | 1.60 | 0.59 | 1.09 |
| 110 | 290 | 150 | 75 | 96.7 | 112.5 | 104.6 | 9.90 | 1.26 | 5.58 | 2.11 | 0.71 | 1.41 |
| 111 | 295 | 150 | 75 | 99.3 | 145.9 | 122.6 | 11.43 | 1.10 | 6.26 | 3.96 | 0.55 | 2.26 |
| 112 | 280 | 450 | 75 | 110.2 | 121.7 | 116.0 | 8.95 | 1.21 | 5.08 | 2.50 | 0.68 | 1.59 |
| 113 | 285 | 450 | 75 | 98.7 | 120.9 | 109.8 | 10.55 | 1.33 | 5.94 | 2.75 | 0.70 | 1.73 |
| 114 | 290 | 450 | 75 | 119.6 | 118.6 | 119.1 | 8.07 | 1.31 | 4.69 | 1.49 | 0.69 | 1.09 |
| 115 | 295 | 450 | 75 | 92.5 | 140.8 | 116.7 | 10.30 | 1.47 | 5.88 | 2.54 | 0.90 | 1.72 |
| 116 | 280 | 150 | 100 | 116.5 | 147.4 | 131.9 | 9.36 | 1.10 | 5.23 | 2.73 | 0.41 | 1.57 |
| 117 | 285 | 150 | 100 | 124.6 | 129.8 | 127.2 | 9.36 | 1.23 | 5.29 | 1.90 | 0.53 | 1.21 |
| 118 | 290 | 150 | 100 | 130.7 | 170.1 | 150.4 | 9.77 | 1.23 | 5.50 | 3.34 | 0.65 | 2.00 |
| 119 | 295 | 150 | 100 | 96.7 | 123.9 | 110.3 | 10.24 | 1.19 | 5.72 | 3.32 | 0.69 | 2.01 |
| 120 | 280 | 450 | 100 | 100.3 | 114.9 | 107.6 | 5.38 | 1.13 | 3.26 | 1.14 | 0.55 | 0.85 |
| 121 | 285 | 450 | 100 | 107.1 | 138.4 | 122.8 | 7.58 | 1.51 | 4.55 | 1.46 | 0.78 | 1.12 |
| 122 | 290 | 450 | 100 | 84.3 | 128.7 | 106.5 | 9.28 | 1.34 | 5.31 | 2.72 | 0.70 | 1.71 |
| 123 | 295 | 450 | 100 | 107.3 | 132.8 | 120.1 | 9.30 | 1.51 | 5.40 | 1.52 | 0.76 | 1.14 |

As can be seen from the Tables 1-3, the nonwovens produced from the blends of the present invention have a tear strength 2 to 3 times greater than the tear strength of the nonwoven fabric prepared from the polylactide alone. Although the blends exhibited a lower tensile strength, the values for the tensile strength indicated that the nonwoven web has sufficient strength for most, if not all, contemplated applications.

While the invention has been described in terms of its best mode and other embodiments, variations and modifications will be apparent to those of skill in the art. It is intended that the attached claims include and cover all such variations and modifications as do not materially depart from the broad scope of the invention as described therein.

We claim:

1. A biodegradable nonwoven web prepared from a polymer blend comprising from about 65% by weight to about 99% by weight of a biodegradable aliphatic polyester polymer and from about 1% by weight to about 35% by weight of a second polymer which is amorphous and is selected from the group consisting of a polymer having a lower melting point than the aliphatic polyester polymer, a polymer having a lower molecular weight than the aliphatic polyester polymer and mixtures thereof and wherein the second polymer comprises a polyalphaolefin.

2. The biodegradable nonwoven web of claim 1, wherein the aliphatic polyester comprises at least one polymer selected from polyhydroxy butyrate (PHP), polyhydroxy butyrate-co-valerate (PHBV), polycaprolactane, polybutylene succinate, polybutylene succinate-co-adipate, polyglycolic acid (PGA), polylactide or polylactic acid (PLA), polybutylene oxalate, polyethylene adipate, polyparadioxanone, polymorpholineviones, or polydioxipane-2-one.

3. The biodegradable nonwoven web of claim 2, wherein the aliphatic polyester comprises a polylactide.

4. The biodegradable nonwoven web of claim 3, wherein the polylactide comprises a poly(L-lactide) having a D-isomer, if present, in an amount less than 3%.

5. The biodegradable nonwoven web of claim 4 wherein the polylactide comprises a poly(L-lactide) having a D-isomer, if present, in an amount less than 2%.

6. The biodegradable nonwoven web of claim 1, wherein the nonwoven web is a meltblown nonwoven web, a spunbond nonwoven web, a bonded carded web or an airlaid nonwoven web.

7. The biodegradable nonwoven web of claim 6, wherein the nonwoven web is a spunbond nonwoven web.

8. The biodegradable nonwoven web of claim 1, wherein the nonwoven web comprises multicomponent fibers, wherein at least a portion of an outer surface of the multicomponent fibers comprises the polymer blend.

9. The biodegradable nonwoven web of claim 1, wherein the nonwoven web is a spunbond nonwoven web, the biodegradable polymer comprises a polylactide having a D-lactide isomer content less than about 3% by weight, based on the weight of the polylactide, and the blend comprises from about 85-98% by weight of the polylactide and from about 2-15% by weight of the second polymer.

10. The biodegradable nonwoven web of claim 1, wherein the nonwoven web is a spunbond nonwoven web, the biodegradable polymer comprises a polylactide having less than about 3% by weight of a D-lactide isomer and the blend comprises from about 65-75% by weight of the polylactide and from about 25-35% by weight of the second polymer.

11. A personal care product comprising the nonwoven web of claim 1 as a component of the product.

12. The personal care product of claim 11, wherein the personal care product is a diaper.

13. The personal care product of claim 11, wherein the personal care product is a feminine hygiene pad.

14. The personal care product of claim 11, wherein the personal care product is a training pant.

15. A medical garment comprising the nonwoven web of claim 1.

16. The medical garment of claim 15, wherein the medical garment is a gown.

17. The medical garment of claim 15, wherein the medical garment is a face mask.

18. A sterile wrap comprising the nonwoven web of claim 1.

19. A wiper comprising the nonwoven web of claim 1.

20. A filter comprising the nonwoven web of claim 1.

21. A method of increasing the tear strength of a biodegradable nonwoven web prepared from a biodegradable aliphatic polyester polymer, said method comprising the steps of forming a blend of a biodegradable aliphatic polyester polymer and a polymer which is amorphous and is selected from the group consisting of a polymer having a lower melting point than the biodegradable aliphatic polyester polymer, a polymer having a lower molecular weight than the biodegradable aliphatic polyester polymer and mixtures thereof and wherein the second polymer comprises a polyalphaolefin; forming a nonwoven web from the blend; and bonding the nonwoven web.

22. A fiber from a polymer blend comprising from about 65% by weight to about 99% by weight of a biodegradable aliphatic polyester polymer and from about 1% by weight to about 35% by weight of a second polymer which is amorphous and is selected from the group consisting of a polymer having a lower melting point than the aliphatic polyester polymer, a polymer having a lower molecular weight than the aliphatic polyester polymer and mixtures thereof and wherein the second polymer comprises a polyalphaolefin.

23. The fiber of claim 22, wherein the fibers is a staple fiber.

24. The fiber of claim 22, wherein the fiber is a substantially continuous filament.

* * * * *